US005613185A

United States Patent [19]

Marsden et al.

[11] Patent Number: 5,613,185

[45] Date of Patent: Mar. 18, 1997

[54] ATMOSPHERES FOR EXTENDING LIFE OF WIRE MESH BELTS USED IN SINTERING POWDER METAL COMPONENTS

[75] Inventors: James G. Marsden, Lenhartsville; Donald J. Bowe, Macungie; Kerry R. Berger, Lehighton; Diwakar Garg, Emmaus; David L. Mitchell, Jr., Coopersburg, all of Pa.

[73] Assignee: Air Products and Chemicals, Inc., Allentown, Pa.

[21] Appl. No.: 456,594

[22] Filed: Jun. 1, 1995

[51] Int. Cl.[6] ..... B22F 1/00

[52] U.S. Cl. ..... 419/58; 148/559; 148/708

[58] Field of Search ..... 419/57, 58; 148/708, 148/559

[56] References Cited

U.S. PATENT DOCUMENTS 4,334,938 6/1982 Shay et al. ..... 148/16.7

5,348,592 9/1994 Garg et al. ..... 148/208

5,417,744 6/1995 Garg et al. ..... 148/208

*Primary Examiner*—Charles T. Jordan

*Assistant Examiner*—Anthony R. Chi

*Attorney, Agent, or Firm*—Willard Jones, II

[57] ABSTRACT

The present invention discloses novel nitrogen-hydrogen based atmospheres for sintering steel components in continuous furnaces with consistent quality and properties while prolonging the life of the wire mesh belts, reducing maintenance costs, and improving furnace productivity. Specifically, it discloses the use of a controlled amount of an oxidizing agent such as moisture, carbon dioxide, nitrous oxide, or mixtures thereof along with nitrogen-hydrogen atmospheres. The amount of an oxidizing agent added to the nitrogen-hydrogen atmospheres to pre-condition belt material prior to its use for sintering and to sinter steel components is controlled in such a way that atmospheres become oxidizing to the belt material but reducing to steel components being sintered, specifically in the high heating and cooling zones of continuous furnaces.

6 Claims, 1 Drawing Sheet

*OXIDATION-REDUCTION DIAGRAM FOR A TYPICAL STAINLESS STEEL*

OXIDATION-REDUCTION DIAGRAM FOR A TYPICAL STAINLESS STEEL

ATMOSPHERES FOR EXTENDING LIFE OF WIRE MESH BELTS USED IN SINTERING POWDER METAL COMPONENTS

TECHNICAL FIELD OF THE INVENTION

The present invention relates to a controlled atmosphere for use in sintering processes for steel components. In particular, the present invention relates an improvement to nitrogen-hydrogen containing atmosphere used in sintering processes for steel components.

BACKGROUND OF THE INVENTION

Powder metallurgy is routinely used to produce a variety of simple- and complex-geometry carbon steel components requiring close dimensional tolerances, good strength and wear resistant properties. The technique involves pressing metal powders that have been premixed with organic lubricants into useful shapes and then sintering them at high temperatures in continuous furnaces into finished products in the presence of controlled atmospheres.

The overall cost of producing components by powder metallurgy has been known to be greatly affected by both the time and money spent on maintaining furnaces and by the cost of controlled atmospheres. The productivity and quality of components, on the other hand, are affected by furnace downtime and consistent composition of controlled atmospheres, respectively. Therefore, there is a need to develop processes and/or atmospheres that will assist in reducing downtime and maintenance costs and improving quality and productivity of components produced by powder metallurgy.

The continuous sintering furnaces normally contain three distinct zones, i.e., a preheating zone, a high heating zone, and a cooling zone. The preheating zone is used to preheat components to a predetermined temperature and to thermally assist in removing organic lubricants from components. The high heating zone is obviously used to sinter components, and the cooling zone is used to cool components prior to discharging them from continuous furnaces.

The high heating zones of continuous furnaces used for sintering steel components are generally operated at temperatures above about 1,000° C. Because of high temperature operation, expensive, high temperature nickel-chromium containing alloys such as Inconel or relatively inexpensive stainless steels are generally used to build sintering furnaces. This is particularly true for building high heating zones of continuous furnaces. The use of these expensive, high temperature alloys helps in prolonging life of continuous furnaces and concomitantly reducing maintenance costs.

The continuous mesh belts used to load and unload components in continuous furnaces are generally made of either expensive, high temperature nickel-chromium containing alloys such as Inconel or relatively inexpensive stainless steels. The expensive, high temperature nickel-chromium containing alloys are preferred materials for building wire mesh belts and obtaining longer life, but they are cost prohibitive and seldom used by the Powder Metal Industry. Although stainless steel mesh belts require frequent maintenance, they are commonly used by the Powder Metal Industry because they are relatively inexpensive.

The controlled atmospheres used for sintering steel components are generally produced and supplied by endothermic generators, ammonia dissociators, or by simply blending pure nitrogen with hydrogen. The endothermic atmospheres are produced by catalytically combusting controlled amount of a hydrocarbon gas, such as natural gas in air in endothermic generators. The endothermic atmospheres typically contain nitrogen (~40%), hydrogen (~40%), carbon monoxide (~20%), and low levels of impurities, such as carbon dioxide, oxygen, and methane. The atmospheres produced by dissociating ammonia contain hydrogen (~75%), nitrogen (~25%), and impurities in the form of undissociated ammonia, oxygen, and moisture. The composition and level of impurities present in endothermically produced atmospheres and those produced by dissociating ammonia are known to change with time, due to catalyst degradation, continuous changes in composition of the feed stock, or leaks in the system caused by high-temperature operation. The changes in the composition and impurity levels in these atmospheres present problems in providing a decent carbon control and producing parts reproducibly with consistent quality. Also, there is always a threat of exposing workers to environmentally unfriendly and harmful carbon monoxide and ammonia with the use of these endothermically generated and dissociated ammonia atmospheres, respectively. Therefore, the Powder Metal Industry has been moving away from using these endothermically generated and dissociated ammonia atmospheres for sintering steel components requiring good carbon control, consistent quality and properties.

Nitrogen-hydrogen atmospheres produced by blending pure nitrogen with hydrogen have been used by the Powder Metal Industry for more than 15 years as alternatives to endothermically generated and dissociated ammonia atmospheres. Because these atmospheres are produced by blending pure nitrogen and hydrogen, they avoid problems associated with the exposure of workers to environmentally unfriendly and harmful gases. Furthermore, since the composition and flow rates of these atmospheres can be easily changed and precisely controlled, they have been widely accepted by the Powder Metal Industry for sintering steel components that require good carbon control, consistent quality and properties.

Although pure nitrogen-hydrogen atmospheres containing less than 5 ppm oxygen and −62° C. [−80° F.] dew point (less than 10 ppm moisture) have been very useful in producing steel components with good quality, consistency, and properties, they have been found to impact negatively on the life of wire mesh belts made of both expensive, nickel-chromium containing alloys and relatively inexpensive stainless steels, thereby increasing downtime and maintenance costs. Therefore, there is a need to develop improved nitrogen-hydrogen based atmospheres for producing steel components by powder metallurgy with consistent quality and properties while improving life of wire mesh belts and reducing downtime and maintenance costs.

SUMMARY OF THE INVENTION

The present invention discloses novel nitrogen-hydrogen based atmospheres for sintering steel components with consistent quality and properties while prolonging life of wire mesh belts made of both expensive, nickel-chromium containing alloys and relatively inexpensive stainless steels and reducing maintenance costs. Specifically, it discloses the use of controlled amount of a gaseous oxidizing agent such as moisture, carbon dioxide, nitrous oxide, or mixtures thereof along with nitrogen-hydrogen atmospheres to (1) sinter steel components with Consistent quality and properties, (2) prolong life of wire mesh belts, (3) reduce downtime and maintenance costs, and (4) reduce the formation of soot in the furnace. The use of a controlled amount of an oxidizing agent has been unexpectedly found to form a protective and adherent oxide layer on the wire mesh belt material, eliminate complete reduction of the belt material in the heating zone of the furnace, increase high temperature strength of the belt material by facilitating grain growth and prevent sticking of sintered components on the belt material, all of which are responsible for significantly increasing the belt life by reducing (1) erosion of the belt material caused by cyclic oxidation in the preheating zone of the furnace or in the ambient atmosphere outside the furnace and reduction in the high heating zone of the furnace and (2) embrittlement of belt material caused by the formation of metal carbides and nitrides, and (3) degradation of belt material by splashing of foreign material from components being processed onto the belt. The amount of an oxidizing agent added to the nitrogen-hydrogen atmospheres to sinter steel components is controlled in such a way that the atmospheres become oxidizing to the belt material but reducing to the steel components being sintered, specifically in the high heating and cooling zones of continuous furnaces.

DETAILED DESCRIPTION OF THE INVENTION

Figure 1:
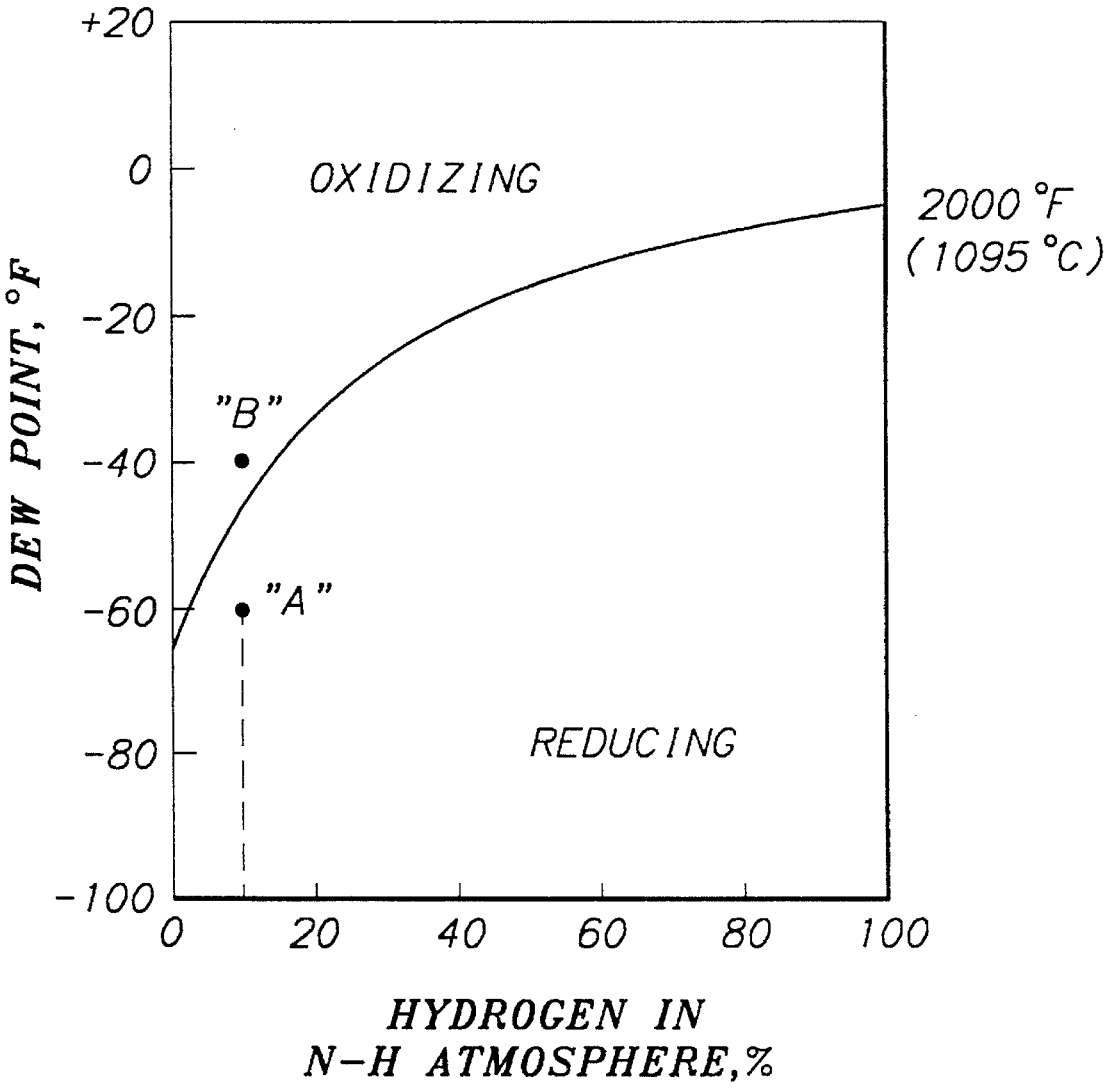
FIG. 1 shows an oxidation-reduction diagram for a typical stainless steel.

Powder metallurgy is routinely used to produce a variety of simple- and complex-geometry steel components requiring close dimensional tolerances, good strength and wear resistant properties. The technique involves pressing metal powders that have been premixed with organic lubricants into useful shapes and then sintering them at high temperatures in continuous furnaces into finished products in the presence of controlled atmospheres. The overall cost of producing parts by powder metallurgy has been known to be greatly affected by both the time and money spent on maintaining the furnace and cost of controlled atmosphere. The productivity and quality of parts, on the other hand, are affected by furnace downtime and consistent composition of the controlled atmospheres, respectively. Therefore, there is a need to develop processes and/or atmospheres that will assist in reducing downtime and maintenance costs and improving quality and productivity of parts produced by powder metallurgy.

Continuous furnaces used for sintering steel components are generally operated at high temperatures (above about 1,000° C. [1832° F.]). Because of high temperature operation, expensive, high temperature alloys such as Inconel 601®, Inconel 625®, RA 330®, RA 600®, RA 601®, RA 353MA®, and HR120® or relatively inexpensive stainless steels are used to build sintering furnaces. This is particularly true for building heating zones of continuous furnaces. The use of these expensive, high temperature alloys helps in prolonging life of continuous furnaces and concomitantly reducing the maintenance cost.

The mesh belts used to load and unload steel components in continuous furnaces are generally made of either expensive, high temperature nickel-chromium containing alloys such as Inconel 601®, Inconel 625®, etc. or relatively inexpensive stainless steels such as SS-304, SS-310, SS-314, SS-316, etc. The expensive, high temperature nickel-chromium containing alloys are preferred materials for building mesh belts and obtaining longer life, but they are cost prohibitive and seldom used by the Powder Metal Industry. Although stainless steel mesh belts require frequent maintenance, they are commonly used by the Powder Metal Industry because they are relatively inexpensive.

The controlled atmospheres used for sintering steel components are generally produced and supplied by endothermic generators, ammonia dissociators, or by simply blending pure nitrogen with hydrogen. The endothermic atmospheres are produced by catalytically combusting controlled amount of a hydrocarbon gas, such as natural gas in air in endothermic generators. The endothermic atmospheres typically contain nitrogen (~40%), hydrogen (~40%), carbon monoxide (~20%), and low levels of impurities, such as carbon dioxide, oxygen, and methane. The atmospheres produced by dissociating ammonia contain hydrogen (~75%), nitrogen (~25%), and impurities in the form of undissociated ammonia, oxygen, and moisture. The composition and level of impurities present in endothermically produced atmospheres and those produced by dissociating ammonia are known to change with time, due to catalyst degradation, continuous changes in the composition of the feed stock, or leaks in the system caused by high-temperature operation. The changes in the composition and impurity levels in these atmospheres present problems in providing a decent carbon control and producing parts reproducibly with consistent quality. Also, there is always a threat of exposing workers to environmentally unfriendly and harmful carbon monoxide and ammonia with the use of these endothermically generated and dissociated ammonia atmospheres, respectively. Therefore, the powder metal industry is moving away from using these endothermically generated and dissociated ammonia atmospheres for sintering steel components requiring good carbon control, consistent quality and properties.

Nitrogen-hydrogen atmospheres produced by blending pure nitrogen with hydrogen have been used by the Powder Metal Industry for more than 15 years as alternatives to endothermically generated and dissociated ammonia atmospheres. Because these atmospheres are produced by blending pure nitrogen and hydrogen, they avoid all the problems associated with the exposure of workers to environmentally unfriendly and harmful gases. Furthermore, since the composition and flow rates of these atmospheres can be easily changed and precisely controlled, they have been widely accepted by the Powder Metal Industry for sintering steel components that require good carbon control, consistent quality and properties.

Although pure nitrogen-hydrogen atmospheres containing less than 5 ppm oxygen and −62° C. [−80° F.] dew point (less than 10 ppm moisture) have been very useful in producing steel components with good quality, consistency, and properties, they have been found to impact negatively on the life of wire mesh belts made of both expensive, nickel-chromium containing alloys and relatively inexpensive stainless steels, thereby increasing downtime and maintenance costs. Therefore, there is a need to develop improved nitrogen-hydrogen based atmospheres for producing steel components by powder metallurgy with consistent quality and properties while improving life of wire mesh belts and reducing downtime and maintenance costs.

It is believed that the wire mesh belt material undergoes cyclic oxidation and reduction while sintering steel components in nitrogen-hydrogen atmospheres. Specifically, the belt material oxidizes in the preheating zone or in the ambient atmosphere and reduces in the high heating zone of the furnace by the nitrogen-hydrogen atmospheres. This cyclical oxidation and reduction of the belt material results in loss of belt material and increased stress due to continuous erosion and corrosion and reduced cross sectional area of the wire, respectively. Additionally, the belt material in the reduced form in the heating zone of the furnace is subjected to nitriding and carburizing conditions, causing embrittlement of the belt material due to the formation of metal carbides and nitrides. The erosion and corrosion of belt material coupled with embrittlement by the formation of metal carbides and nitrides result in rapid degradation of the belt material and eventually failure of the belt.

It is also believed that the life of the belt is greatly reduced by the reaction between belt material and foreign materials splashed or flowed onto the belt in the high heating zone of the furnace. This reaction promotes the formation of low-melting point alloys, resulting in premature failure of the belt. The alloying of the belt material with foreign material is accelerated in the high heating zone of the furnace where the belt material is in the reduced form. For example, the life of stainless steel belt is greatly reduced by forming low-melting point alloys with copper splashed onto the stainless steel belt material. Copper is generally used to improve mechanical properties of iron carbon components by infiltrating it into the matrix during sintering, It is also believed that the life of the belt is greatly reduced by erosion and corrosion caused by sticking of sintered components on the belt material, resulting in premature failure of the belt. The sticking of sintered components on the belt material is accelerated in the high heating zone of the furnace where the belt material is in the reduced form.

The premature failure of wire mesh belt due either to cyclic oxidation and reduction, formation of metal nitrides and carbides, formation of and low-melting point alloys, or sticking of sintered components on the belt material results in down time and loss in production. Therefore, there is a need to develop improved nitrogen-hydrogen atmospheres for producing steel components by the powder metallurgy with consistent quality and properties while improving life of wire mesh belts and reducing maintenance costs.

It has surprisingly been found that the life of wire mesh belts can be increased significantly by adding controlled amount of a gaseous oxidant such as moisture, carbon dioxide, nitrous oxide, or mixtures thereof to the nitrogen-hydrogen atmospheres used for sintering steel components. The use of a controlled amount of an oxidizing agent has been unexpectedly found to form a protective and adherent oxide layer on the belt material, eliminate complete reduction of the belt material in the heating zone of the furnace, increase high temperature strength of the belt material by facilitating grain growth and prevent sticking of sintered components on the belt material, all of which are responsible for significantly increasing the belt life by reducing (1) erosion of the belt material caused by cyclic oxidation in the preheating zone of the furnace or in the ambient atmosphere outside the furnace and reduction in the high heating zone of the furnace, (2) embrittlement of belt material caused by the formation of metal carbides and nitrides, and (3) the degradation of belt material by splashing of foreign material from parts being processed onto the belt. The amount of an oxidizing agent added along with nitrogen-hydrogen atmospheres to sinter steel components is controlled in such a way that the atmospheres become oxidizing to the belt material but reducing to the steel components being sintered, specifically in the high heating and cooling zones of continuous furnaces.

It has also been surprisingly found that the life of the belt can be further improved by pre-conditioning new belts in nitrogen-based atmospheres containing a controlled amount of a gaseous oxidant such as moisture, carbon dioxide, nitrous oxide, or mixtures thereof. Once again, the use of controlled amount of an oxidizing agent has been unexpectedly found to form a protective and adherent oxide layer on the belt material and reduce formation of nitrides while pre-conditioning new belt in nitrogen-based atmospheres.

According to the present invention, a continuous furnace equipped with an integrated heating and cooling zones is most suitable for sintering steel components. The continuous furnace is preferably equipped with curtains in the discharge vestibule and a physical door in the feed vestibule to prevent air infiltration. The nitrogen-hydrogen atmosphere containing an oxidizing agent is introduced into the furnace through an inlet port or multiple inlet ports in the transition zone, which is located between the heating and cooling zones of the furnace. It can be introduced through a port located in the heating zone or the cooling zone, or through multiple ports located in the heating and cooling zones.

The nitrogen-hydrogen atmosphere, according to the present invention, contains hydrogen varying from about 0.1% to about 25%. Preferably, it contains hydrogen varying from about 1% to 10%. More preferably, it contains hydrogen varying from about 2% to about 5% by volume. Hydrogen gas used in nitrogen-hydrogen atmosphere can be supplied in gaseous form in compressed gas cylinders or vaporizing liquefied hydrogen. Alternatively, it can be supplied by producing it on-site using an ammonia disssociator.

The nitrogen gas used in nitrogen-hydrogen atmosphere preferably contains less than 10 ppm residual oxygen content. It can be supplied by producing it using well known cryogenic distillation technique. It can alternatively be supplied by purifying non-cryogenical generated nitrogen.

The amount of an oxidizing agent added to the nitrogen-hydrogen atmosphere will depend on the material selected to fabricate wire mesh belt, concentration of hydrogen used in the nitrogen-hydrogen atmosphere, and temperature used to sinter steel components. It is added in such a way that the nitrogen-hydrogen atmosphere becomes oxidizing to the belt material throughout the furnace, but remains reducing to steel components sintered in the furnace.

The oxidizing agent used to prolong the life of belt material can be selected from moisture, carbon dioxide, nitrous oxide, or mixtures thereof. If moisture is used as an oxidizing agent, it can be added by humidifying nitrogen-hydrogen atmospheres. It can also be added by reacting nitrogen stream containing a predetermined amount of oxygen with hydrogen in the presence of a precious metal catalyst. It can also be added by producing moisture by thermally or catalytically reacting a controlled amount of oxygen with hydrogen in-situ in the furnace. In any case, the amount of moisture added will depend on the type of belt material, concentration of hydrogen in nitrogen-hydrogen atmospheres, and temperature selected to sinter steel components. For example, the amount of moisture required to provide oxidizing atmosphere in the heating zone of a sintering furnace operated at 1,095° C. [2003° F.] and equipped with a stainless steel belt will depend on the concentration of hydrogen in the nitrogen-hydrogen atmosphere. Specifically, if the nitrogen-hydrogen atmosphere contains 10% hydrogen by volume, a moisture level close to −40° C. [−40° F.] (point B) or higher will be needed to maintain oxidizing atmosphere for stainless steel belt material in the heating zone of the furnace, as shown in FIG. 1. The nitrogen-hydrogen atmosphere containing −40° C. [−40° F.] (point B in FIG. 1) moisture or slightly higher will still be reducing to steel components being sintered in the heating zone of the furnace. The use of a moisture level close to −51° C. [−60° F.] (point A in FIG. 1) will be insufficient, and will result in reducing stainless steel belt in the heating zone and forming metal nitrides and carbides. It is important to note that the amount of moisture required to provide oxidizing environment to the belt material in the heating zone of the furnace needs to be adjusted up or down depending on the concentration of hydrogen used for sintering, as shown in FIG. 1. For example, the amount of moisture needs to be increased (or decreased) with increased (or decreased) concentration of hydrogen in the nitrogen-hydrogen atmosphere. Furthermore, the amount of moisture required to provide oxidizing environment to the belt material in the heating zone of the furnace needs to be adjusted up or down depending upon the sintering temperature used. This is because of the fact that the curve separating reducing and oxidizing zones in FIG. 1 will shift up with the use of higher sintering temperature and down with lower sintering temperature. Similar curves can be used to establish the amount of moisture needed to maintain oxidizing atmosphere in the heating zones of continuous furnaces equipped with belts made of materials other than stainless steel.

If stainless steel belts are used for sintering steel components above about 1,000° C. [1832° F.], the amount of moisture added to the nitrogen-hydrogen atmosphere containing about 5% hydrogen can range up to about −26° C. [−15° F.] (or about 550 ppm moisture). Preferably, it can be added in a proportion to bring the humidity level of the nitrogen-hydrogen atmosphere to about −32° C. [−25° F.] (or about 300 ppm moisture). More preferably, it can be added in a proportion to bring the humidity level of the nitrogen-hydrogen atmosphere to about −37° C. [−35° F.] (or about 150 ppm moisture).

The amount of carbon dioxide or nitrous oxide added to the nitrogen-hydrogen atmosphere will also vary depending upon the type of belt material, concentration of hydrogen, and sintering temperature selected for the operation. If stainless steel belts are used for sintering steel components above about 1,000° C. [1832° F.], the amount of carbon dioxide or nitrous oxide can vary from about 50 to 1,000 ppm by volume. Preferably, it can vary from about 100 to about 600 ppm. More preferably, it can vary from about 100 to 500 ppm by volume. Carbon dioxide can be supplied in gaseous form in compressed gas cylinders or vaporized liquid form. Likewise, nitrous oxide can be supplied in gaseous form in compressed gas cylinders. It is important to note that a part of carbon dioxide or nitrous oxide will react with hydrogen present in the nitrogen-hydrogen atmosphere in the heating zone and produce moisture. Therefore, both carbon dioxide (or nitrous oxide) and moisture produced in-situ will be instrumental in providing oxidizing atmosphere in the heating zone of the furnace.

A low concentration of an enriching gas such as methane, natural gas, petroleum gas, or propane can be added to the nitrogen-hydrogen atmosphere, if the addition of an oxidizing agent presents problems in controlling carbon content of sintered steel components. The concentration of an enriching gas used for controlling carbon content of sintered steel components can vary from about 0.05 to 1.0% by volume. It can preferably vary from about 0.05 to 0.50%. More preferably it can vary from about 0.05 to 0.25%.

Steel powders that can be used to produce parts by sintering according to the present invention can be selected from Fe, Fe—C with up to 1% carbon, Fe—Cu-C with up to 20% copper and 1% carbon, Fe—Mo—Mn—Cu—Ni—C with up to 1% Mo, Mn, and carbon each and up to 4% Ni and Cu each, Fe—Cr—Mo—Co—Mn—V—W—C with varying concentrations of alloying elements depending upon the final properties of the sintered product desired. Other elements such as B, Al, Si, P, S, etc. can optionally be added to steel powders to obtain the desired properties in the final sintered product. These powders can be mixed with up to 2% zinc stearate or any other lubricant to assist in pressing components from them.

The present invention, therefore, discloses novel atmospheres for increasing life of wire mesh belts that are used in high temperature sintering of steel components. According to the present invention, the life of the wire mesh belts are increased significantly by forming a protective and adherent oxide layer on the belt material with the addition of controlled amount of a gaseous oxidizing agent to the furnace atmosphere. The concentration of a gaseous oxidizing agent added to the furnace atmosphere is controlled in such a way that the atmosphere becomes oxidizing to the belt material, but remains reducing to the steel components processed in the furnace.

The present invention also discloses novel atmospheres for increasing life of wire mesh belts that are used in high temperature sintering of steel components without surface decarburization. According to the present invention, the life of wire mesh belts is increased significantly and surface decarburization of sintered steel components avoided by (1) forming a protective and adherent oxide layer on the belt material with the addition of controlled amount of a gaseous oxidizing agent and (2) maintaining the desired carbon potential in the furnace by adding of a controlled amount of an enriching gas to the furnace atmosphere. The concentrations of gaseous oxidizing agent and enriching gas added to the furnace atmosphere are controlled in such a way that the atmosphere becomes oxidizing to the belt material, but remains reducing to the steel components processed in the furnace and that the carbon potential of the atmosphere present in the furnace is maintained at the desired level.

The present invention also discloses a novel pre-conditioning procedure to further increase life of new belts used in high temperature sintering. According to the novel procedure, the new belt is pre-conditioned by stepwise heating the furnace to about 760° C. [1400° F.] under flowing air or nitrogen mixed with an oxidant while rotating the belt in about 10 to 30 hours. Upon reaching 760° C. [1400° F.] temperature, discontinue flow of air or nitrogen mixed with an oxidant, switch to furnace atmosphere containing nitrogen, hydrogen, and an oxidant, and maintain the temperature for about 1 to 6 hours. Thereafter, increase stepwise the furnace temperature from 760° C. [1400° F.] to the final sintering temperature in about 7 to 30 hours under flowing furnace atmosphere containing nitrogen, hydrogen, and an oxidant to condition the belt and stabilize grain growth and properties of the belt material. The amount of a gaseous oxidizing agent added to nitrogen or the furnace atmosphere is controlled in such a way that the atmosphere is always oxidizing to the belt material during pre-conditioning. The key requirement for pre-conditioning the belt is simply to avoid (1) exposing the belt material to pure nitrogen or a mixture of nitrogen and hydrogen and (2) prematurely nitriding the belt material.

Although the present invention has been described in terms of increasing life of wire mesh belts used in sintering steel components, it is very likely that it will improve the life of various furnace fixtures such as muffle. Furthermore, it can also be applicable for increasing life of wire mesh belts used in high temperature brazing using low dew point brazing pastes or preforms.

EXAMPLE 1

A long-term belt life experiment was carried out in a continuous conveyor belt furnace operated at about 1110° C. [2030° F.] to sinter powder metal components pressed from iron-carbon powder containing 99.2% iron and 0.8% carbon. The powder metal was mixed with about 0.75% lubricant in the form of zinc stearate to assist in pressing of components. The furnace consisted of a 15 in. wide and about 6 in. high muffle. The combined length of pre-heating and heating zones was about 13 ft. The heating zone was followed by about I ft. long transition zone and then with about 12 ft. long cooling zone. A new flexible conveyor belt made of 314 type stainless steel was used in this experiment. It was operated with a fixed belt speed of 3.25 in per minute to feed steel powder metal components into the furnace for sintering.

The flexible conveyor belt was pre-conditioned using the conventional procedure prior to using it for the long-term belt life experiment. Specifically, the new belt was pre-conditioned by stepwise heating the furnace to about 871° C. [1600° F.] under flowing air while rotating the belt in about 28 hours. Upon reaching 871° C. [1600° F.] temperature, the flow of air was turned-off and that of nitrogen-hydrogen furnace atmosphere containing 3% hydrogen was turned-on, and the furnace temperature was maintained for about 1 to 2 hours. Thereafter, the furnace temperature was increased in a stepwise manner from 871° C. [1600° F.] to the final sintering temperature of about 2030° F. in about 14 hours under flowing furnace atmosphere. The belt was conditioned under flowing nitrogen-hydrogen atmosphere at 1110° C. [2030° F.] for another 6 to 8 hours prior to using it to sinter steel components.

The long-term sintering experiment was carried out in the presence of a nitrogen-hydrogen atmosphere containing 3% hydrogen. The atmosphere was introduced through an inlet port in the transition zone that was located between the high heating and cooling zones of the furnace. Samples of the furnace atmosphere taken at different time intervals revealed that it contained less than 3 ppm oxygen and less than −55° C. dew point (less than 15 ppm moisture).

The long-term test was unfortunately discontinued only after 8 weeks of continuous testing due to failure of the stainless steel belt. The belt was broken into multiple pieces rendering it to be useless. Besides failure of the belt, sintered steel components were found to stick badly to the belt material. Post analysis of the failed belt revealed (1) surface erosion by cyclic oxidation and reduction and (2) embrittlement by nitriding and carburizing to be the main reasons of belt failure.

Further analysis of the furnace atmosphere revealed it to be mildly oxidizing to the stainless steel belt in the pre-heating and cooling zones, but reducing in the high heating zone. The belt material was, therefore, subjected to a continuous and cyclic oxidation and reduction process, causing it to erode and fail prematurely. In addition to the cyclic oxidation and reduction process, the belt material was nitride from the nitrogen present in the furnace atmosphere and carburized from the hydrocarbons released into the furnace atmosphere by the removal of lubricants from the components. The nitriding and carburizing of the belt material was accelerated in the high heating zone where the furnace atmosphere was reducing to the belt material and where the belt material was in the reduced form. The formation of nitride and carbides embrittled the belt material and helped in premature failure of the belt.

The above long-term test results showed that neither the conventional new belt pre-conditioning procedure nor the nitrogen-hydrogen furnace atmosphere was suitable for providing acceptable belt life. Furthermore, the results showed that the use of nitrogen-hydrogen atmosphere was not desirable because of steel components sticking to the belt material.

EXAMPLE 2

Another long-term belt life experiment was carried out in a continuous conveyor belt furnace similar to the one described in Example 1. The furnace was again operated at about 1110° C. [2030° F.] to sinter powder metal components pressed from a similar iron-carbon powder used in Example 1. A new 314 stainless steel flexible conveyor belt similar to the one in Example 1 was used to feed steel powder metal components into the furnace for sintering. The new belt was pre-conditioned using a procedure similar to the one described in Example 1 prior to sintering steel components.

The long-term sintering experiment was carded out in the presence of a nitrogen-hydrogen atmosphere containing 3% hydrogen. Approximately 260 ppm of moisture as an oxidant was mixed with the nitrogen-hydrogen atmosphere prior to its introduction into the furnace through the inlet port located in the transition zone during sintering steel components. Samples of the furnace atmosphere taken at different time intervals revealed that it contained less than 3 ppm oxygen and about −35° C. [−31° F.]dew point (close to 250 ppm moisture).

The long-term test results showed some signs of belt failure only after about 17 weeks of continuous testing, more than doubling the life of the belt material. Besides longer belt life, the sintered steel components were unexpectedly found not to stick to the belt material.

It is believed that the belt life more than doubled because of the fact that the addition of approximately 260 ppm of moisture caused the furnace atmosphere to become mildly oxidizing to stainless steel belt in the high heating zone in addition to pre-heating and cooling zones. The presence of moisture in the atmosphere helped in forming a protective oxide layer on the stainless steel belt material, thereby eliminating erosion and corrosion of the belt material by cyclic oxidation and reduction and reducing the embrittlement of belt material by limiting the rate of nitriding and carburizing of the belt material.

Several steel components that were sintered during the long-term test were sectioned and analyzed for microstructure and properties. They were all found to meet dimensional change, surface hardness, and transverse rupture strength specifications. Furthermore, the sectioned components showed either negligible or no signs of surface decarburization.

This example therefore shows that the life of stainless steel belt can be substantially increased by adding a controlled amount of an oxidant such as moisture to the nitrogen-hydrogen atmosphere.

EXAMPLE 3

Another long-term belt life experiment was carried out in a continuous conveyor belt furnace similar to the one described in Example 1. The furnace was again operated at about 1110° C. [2030° F.] to sinter powder metal components pressed from a similar iron-carbon powder used in Example 1. A new 314 stainless steel flexible conveyor belt similar to the one in Example 1 was used to feed steel powder metal components into the furnace for sintering. The new belt was pre-conditioned using a procedure similar to the one described in Example 1 prior to sintering steel components.

The long-term sintering experiment was carried out in the presence of a nitrogen-hydrogen atmosphere containing 3% hydrogen. Approximately 300 ppm of carbon dioxide as an oxidant was mixed with the nitrogen-hydrogen atmosphere prior to its introduction into the furnace through the inlet port located in the transition zone during sintering steel components. Samples of the furnace atmosphere taken at different time intervals revealed that it contained less than 3 ppm oxygen and about45° C. [–49° F.] dew point or close 70 ppm moisture in the high heating and pre-heating zones of the furnace. The moisture present in the high heating zone was produced insitu by the reaction between carbon dioxide and hydrogen that were present in the feed gas.

The long-term test results showed some signs of belt failure only after about 17 weeks of continuous testing, more than doubling the life of the belt material. Besides longer belt life, the sintered steel components were unexpectedly found not to stick to the belt material.

Once again, it is believed that the belt life more than doubled because of the fact that the addition of approximately 300 ppm of carbon dioxide and in-situ formation of moisture in the furnace caused the furnace atmosphere to become mildly oxidizing to stainless steel belt in the high heating zone in addition to pre-heating and cooling zones. The presence of both carbon dioxide and in-situ formed moisture in the atmosphere helped in forming a protective oxide layer on the stainless steel belt material, thereby eliminating erosion and corrosion of the belt material by cyclic oxidation and reduction and reducing the embrittlement of belt material by limiting the rate of nitriding and carburizing of the belt material.

Several steel components that were sintered during the long-term test were sectioned and analyzed for microstructure and properties. They were all found to meet dimensional change, surface hardness, and transverse rupture strength specifications. Furthermore, the sectioned components showed either negligible or no signs of surface decarburization.

This example therefore shows that the life of stainless steel belt can be substantially increased by adding a controlled amount of an oxidant such as carbon dioxide to the nitrogen-hydrogen atmosphere.

EXAMPLES 4 & 5

The long-term belt life experiments described in Examples 2 and 3 were repeated using similar furnace, belt pre-conditioning procedure, nitrogen-hydrogen furnace atmosphere containing 3% hydrogen, and with 260 ppm moisture and 300 ppm carbon dioxide, respectively. The test results showed some signs of belt failure only after about 17 weeks of continuous testing, once again more than doubling the life of the belt material.

Several samples of belt material were taken prior to initiating sintering of steel components and every two weeks during sintering of steel components to identify the mechanism of belt failure. The analysis of virgin belt material showed it to be very tough and ductile. It was still tough and ductile immediately after pre-conditioning the belt material and prior to using it for sintering steel components. There was, however, signs of nitrogen pick-up by the belt material during pre-conditioning following the conventional procedure. The belt material retained some ductility even after six weeks of continuous operation. It continued to pick-up additional nitrogen, but at considerably lower rate than that noted with pure nitrogen-hydrogen atmosphere. The belt material finally failed due to pick-up of enough nitrogen and carbon from the atmosphere.

This example therefore shows that the life of stainless steel belt starts to degrade during pre-conditioning it or prior to using it for sintering steel components. It also shows that the belt life can be further increased simply by limiting the pick-up of nitrogen by the belt material during pre-conditioning time.

EXAMPLE 6

Another long-term belt life experiment was carried out in a continuous conveyor belt furnace similar to the one described in Example 1. The furnace was again operated at about 1110° C. [2030° F.] to sinter powder metal components pressed from a iron-carbon powder similar to the one used in Example 1. A new 314 stainless steel flexible conveyor belt similar to the one in Example 1 was used to feed carbon steel powder metal components into the furnace for sintering. The new belt was pre-conditioned using a new procedure to avoid pre-mature nitriding of belt material prior to sintering steel components.

The flexible conveyor belt made of 314 type stainless steel was pre-conditioned by stepwise heating the furnace to about 760° C. [1400° F.] under flowing air while rotating the belt in about 28 hours. Upon reaching 760° C. [1400° F.] temperature, the flow of air was turned-off and that of nitrogen-hydrogen furnace atmosphere containing 3% hydrogen and 260 ppm moisture was turned-on, and the furnace temperature was maintained for about 1 to 2 hours. Thereafter, the furnace temperature was increased in a stepwise manner from 760° C. [1400° F.] to the final sintering temperature of about 2030° F. in about 14 hours under flowing nitrogen-hydrogen furnace atmosphere containing moisture. The furnace was conditioned under flowing nitrogen-hydrogen atmosphere containing moisture at 1110° C. [2030° F.] for another 6 to 8 hours prior to sintering steel components.

The long-term sintering experiment was carried out in the presence of a nitrogen-hydrogen atmosphere containing 3% hydrogen and 260 ppm of moisture. Samples of the furnace atmosphere taken at different time intervals revealed that it contained less than 3 ppm oxygen and about –35° C. [–31° F.] dew point (close to 250 ppm moisture).

The long-term test results showed some signs of belt failure only after about 22 weeks of continuous testing, Analysis of a belt sample taken immediately after pre-conditioning the belt material or just prior to sintering steel components showed no signs of nitrogen-pick-up by the belt material. It also showed excellent grain growth that was responsible for increasing high temperature strength of the belt material.

Several steel components that were sintered during the long-term test were sectioned and analyzed for microstructure and properties. They were all found to meet dimensional change, surface hardness and transverse rupture strength specifications. Furthermore, the sectioned components showed either negligible or no signs of surface decarburization.

It is believed that the belt life increased by an additional 5 weeks because of the fact that the addition of approximately 260 ppm of moisture caused the furnace atmosphere to become mildly oxidizing to stainless steel belt during pre-conditioning, thereby facilitating grain growth and avoiding pre-mature nitriding of the belt material. Besides increasing the belt life, the addition of a controlled amount of moisture to the nitrogen-hydrogen furnace atmosphere helped in preventing sticking of sintered components to the belt material.

This example therefore shows that the life of stainless steel belt can be substantially increased by using moisture as an oxidant along with nitrogen-hydrogen furnace atmosphere during pre-conditioning the belt material and while sintering steel components.

EXAMPLE 7

Another long-term belt life experiment was carried out in a continuous conveyor belt furnace similar to the one described in Example 1. The furnace was again operated at about 1110° C. [2030° F.] to sinter powder metal components pressed from a iron-carbon powder similar to the one used in Example 1. A new 314 stainless steel flexible conveyor belt similar to the one in Example 1 was used to feed carbon steel powder metal components into the furnace for sintering. The new belt was pre-conditioned using a new procedure to avoid pre-mature nitriding of belt material prior to sintering steel components.

The flexible conveyor belt made of 314 type stainless steel was pre-conditioned by stepwise heating the furnace to about 760° C. [1400° F.] under flowing air while rotating the belt in about 28 hours. Upon reaching 760° C. [1400° F.] temperature, the flow of air was turned-off and that of nitrogen-hydrogen furnace atmosphere containing 3% hydrogen and 300 ppm carbon dioxide was turned-on, and the furnace temperature was maintained for about 1 to 2 hours. Thereafter, the furnace temperature was increased in a stepwise manner from 760° C. [1400° F.] to the final sintering temperature of about 1110° C. [2030° F.] in about 14 hours under flowing nitrogen-hydrogen furnace atmosphere containing carbon dioxide. The furnace was conditioned under flowing nitrogen-hydrogen atmosphere containing carbon dioxide at 2030° F. for another 6 to 8 hours prior to sintering steel components.

The long-term sintering experiment was carried out in the presence of a nitrogen-hydrogen atmosphere containing 3% hydrogen and 300 ppm carbon dioxide. Samples of the furnace atmosphere taken at different time intervals revealed that it contained less than 3 ppm oxygen and about −45° C. [−49° F.] dew point or close 70 ppm moisture in the high heating and pre-heating zones of the furnace. The moisture present in the high heating zone was produced in-situ by the reaction between carbon dioxide and hydrogen that were present in the feed gas.

The long-term test results showed some signs of belt failure only after about 23 weeks of continuous testing, Analysis of a belt sample taken immediately after pre-conditioning the belt material or just prior to sintering steel components showed no signs of nitrogen-pick-up by the belt material. It also showed excellent grain growth that was responsible for increasing high temperature strength of the belt material.

Several steel components that were sintered during the long-term test were sectioned and analyzed for microstructure and properties. They were all found to meet dimensional change, surface hardness and transverse rupture strength specifications. Furthermore, the sectioned components showed either negligible or no signs of surface decarburization.

It is believed that the belt life increased by more than 5 weeks because of the fact that the addition of approximately 300 ppm of carbon dioxide caused the furnace atmosphere to become mildly oxidizing to stainless steel belt during pre-conditioning, thereby facilitating grain growth and avoiding pre-mature nitriding of the belt material. Besides increasing the belt life, the addition of a controlled amount of carbon dioxide to the nitrogen-hydrogen furnace atmosphere helped in preventing sticking of sintered components to the belt material.

This example therefore shows that the life of stainless steel belt can be substantially increased by using carbon dioxide as an oxidant along with nitrogen-hydrogen furnace atmosphere during pre-conditioning the belt material and while sintering steel components.

EXAMPLE 8

Another long-term belt life experiment was carried out in a continuous conveyor belt furnace similar to the one described in Example 1. The furnace was again operated at about 1110° C. [2030° F.] to sinter powder metal components pressed from an iron-carbon powder similar to the one used in Example 1. A new 314 stainless steel flexible conveyor belt similar to the one in Example 1 was used to feed carbon steel powder metal components into the furnace for sintering. The new belt was pre-conditioned using a new procedure to avoid premature nitriding of the belt material prior to sintering steel components.

The flexible conveyor belt made of 314 stainless steel was pre-conditioned by stepwise heating the furnace to about 760° C. [1400° F.] under flowing air while rotating the belt in about 28 hours. Upon reaching 760° C. [1400° F.], the flow of air was turnedoff and a flow of the nitrogen-hydrogen furnace atmosphere containing moisture was initiated. The furnace was maintained at 760° C. [1400° F.] for two (2) hours. Thereafter, the furnace temperature was then increased in a stepwise manner from 760° C. [1400° F.] to the final sintering temperature of 1110° C. [2030° F.] in about 14 hours under the nitrogen-hydrogen furnace atmosphere containing moisture. The furnace was then maintained at 1110° C. [2030° F.] for another 6 to 8 hours prior to sintering steel components.

The long-term sintering experiment was carried out in the presence of a nitrogen-hydrogen atmosphere containing 3% hydrogen, 260 ppm of moisture and 0.25% natural gas. The natural gas was added to the nitrogen-hydrogen-moisture atmosphere to avoid any possibility of decarburizing surfaces of parts during sintering. Samples of the furnace atmosphere taken at different time intervals revealed that it contained less than 3 ppm oxygen and about −35° C. [−31° F.] dew point or close to 250 ppm moisture.

The long-term test results showed some signs of belt failure only after about 24 weeks of continuous testing, Analysis of a belt sample taken immediately after pre-conditioning the belt material or just prior to sintering steel components showed no signs of nitrogen-pick-up by the belt material. It also showed excellent grain growth that was responsible for increasing high temperature strength of the belt material.

Several steel components that were sintered during the long-term test were sectioned and analyzed for microstructure and properties. They were all found to meet dimensional change, surface hardness and transverse rupture strength specifications. Furthermore, the sectioned components showed no signs of surface decarburization.

It is believed that the belt life increased by more than 6–7 weeks because of the fact that the addition of approximately 260 ppm of moisture caused the furnace atmosphere to become mildly oxidizing to stainless steel belt during pre-conditioning, thereby facilitating grain growth and avoiding pre-mature nitriding of the belt material. Besides increasing the belt life, the addition of a controlled amount of moisture to the nitrogen-hydrogen furnace atmosphere helped in preventing sticking of sintered components to the belt material.

This example therefore shows that the life of stainless steel belt can be significantly increased by using moisture as an oxidant along with nitrogen-hydrogen furnace atmosphere during pre-conditioning the belt material and while sintering steel components.

We claim:

1. A process for sintering of steel components in a furnace at an elevated temperature wherein such sintering is carried out in an atmosphere comprising nitrogen and hydrogen and wherein such steel parts are supported in the furnace on a belt comprised of a wire mesh material, characterized in that an effective amount of a gaseous oxidant is added to the furnace such that the resulting atmosphere in the furnace is oxidizing to the belt material yet reducing to the steel components thus enabling an extended belt life.

2. The process of claim 1 wherein the gaseous oxidant is selected from the group consisting of water, carbon dioxide, nitrous oxide and mixtures thereof.

3. The process of claim 1 wherein the sintered steel components have a carbon content and which further comprises adding an enriching gas selected from the group consisting of methane, natural gas, petroleum gas or propane to the furnace such that the concentration of the enriching gas in the furnace is between 0.05 and 1.0 percent by volume thereby preventing surface decarburization of the sintered components.

4. The process of claim 3 wherein the concentration of the enriching gas is between 0.05 and 0.5 percent by volume.

5. The process of claim 3 wherein the concentration of the enriching gas is between 0.05 and 0.25 percent by volume.

6. The process of claim 1 wherein the belt is pre-conditioned by: (a) stepwise heating of the belt over a period of time between 10 to 30 hours to a temperature of about 760° C. [1400° F.] under flowing air or nitrogen mixed with an oxidant; (b) upon reaching 760° C. [1400° F.], discontinuing the flow of air or nitrogen mixed with an oxidant, initiating an atmosphere containing nitrogen, hydrogen and an gaseous oxidant which is oxidizing to the belt and maintaining the 760° C. [1400° F.] temperature for about 1 to 6 hours; and (c) stepwise heating of the belt over a period of time between 7 and 30 hours to the final sintering temperature of the furnace in the atmosphere containing nitrogen, hydrogen and an gaseous oxidant.

* * * * *